US010201972B2

(12) United States Patent
Saito et al.

(10) Patent No.: US 10,201,972 B2
(45) Date of Patent: Feb. 12, 2019

(54) RECORDING ELEMENT SUBSTRATE AND LIQUID EJECTION HEAD

(71) Applicant: CANON KABUSHIKI KAISHA, Tokyo (JP)

(72) Inventors: Akiko Saito, Tokyo (JP); Shintaro Kasai, Yokohama (JP); Yoshiyuki Nakagawa, Kawasaki (JP); Takatsugu Moriya, Tokyo (JP); Koichi Ishida, Tokyo (JP); Shinji Kishikawa, Tokyo (JP); Takayuki Sekine, Kawasaki (JP); Shuzo Iwanaga, Kawasaki (JP); Tatsuya Yamada, Kawasaki (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 15/598,212

(22) Filed: May 17, 2017

(65) Prior Publication Data

US 2017/0334203 A1 Nov. 23, 2017

(30) Foreign Application Priority Data

May 23, 2016 (JP) ..... 2016-102182

(51) Int. Cl.
*B41J 2/14* (2006.01)

(52) U.S. Cl.
CPC ..... *B41J 2/1433* (2013.01)

(58) Field of Classification Search
CPC ..... B41J 2/1433; B41J 2/14427; B41J 2/335; B41J 2/33505; B41J 2/1404; B41J 2/14016; B41J 2/14032
See application file for complete search history.

(56) References Cited

U.S. PATENT DOCUMENTS 6,422,686 B1 * 7/2002 Ishinaga ..... B41J 2/14024 347/47
9,561,666 B2 * 2/2017 Govyadinov ..... B41J 2/175
9,776,422 B2 * 10/2017 Govyadinov ..... B41J 2/19
2005/0200662 A1 * 9/2005 Eguchi ..... B41J 2/1404 347/65
2010/0201746 A1 * 8/2010 Miyakoshi ..... B41J 2/1404 347/44

(Continued)

FOREIGN PATENT DOCUMENTS

JP 2013-233795 A 11/2013

*Primary Examiner* — Juanita D Jackson
(74) *Attorney, Agent, or Firm* — Canon U.S.A., Inc. IP Division

(57) ABSTRACT

A recording element substrate includes: a substrate on which a plurality of energy generating elements that generate energy used for ejecting liquid are arranged side by side, an ejection port forming member in which ejection ports are formed at positions corresponding to the plurality of energy generating elements, a plurality of supply passages which are channels extending in a thickness direction of the substrate and through which liquid is supplied to the energy generating elements, and a support member that is formed between the substrate and the ejection port forming member and supports the ejection port forming member, in which supply ports that are apertures of the plurality of supply passages are linearly arranged side by side on the substrate, and a plurality of support members are provided side by side between adjacent supply ports on the substrate in a direction in which the supply ports are aligned.

8 Claims, 9 Drawing Sheets

(56) References Cited

U.S. PATENT DOCUMENTS

2010/0282342 A1* 11/2010 Aoyama ..... B41J 2/17563
137/544
2015/0015646 A1* 1/2015 Yoneta ..... B41J 2/14274
347/93

* cited by examiner

RECORDING ELEMENT SUBSTRATE AND LIQUID EJECTION HEAD

BACKGROUND OF THE INVENTION

Field of the Invention

The present disclosure relates to a recoding element substrate and a liquid ejection head.

Description of the Related Art

In a field of a liquid ejection apparatus represented by an ink-jet apparatus, for efficiently using generated energy as ejection energy, it is required to reduce thickness of an ejection port forming member in which ejection ports are formed. When the thickness of the ejection port forming member is reduced, however, strength of the ejection port forming member is reduced. When the liquid ejection apparatus is driven for a long time, it is concerned that a member, such as the ejection port forming member, that forms a liquid ejection head is deformed due to influence of swelling caused by absorption of liquid or influence of heat, and when the thickness is small, in particular, the deformation becomes great. Also in a case where external force is applied to the election port forming member, for example, by a wiping operation for wiping out liquid, when the strength is small, it is considered that the ejection port forming member is broken and ejection performance is deteriorated.

Japanese Patent Laid-Open No. 2013-233795 discloses a liquid ejection head having a support member that is provided between an ejection port forming member and a substrate and supports the ejection port forming member, in order to improve strength of the ejection port forming member and prevent deformation due to swelling. In the liquid ejection head, supply ports, serving as apertures of a supply passage, which penetrate the substrate in a thickness direction are provided so as to hold an energy generating element therebetween. With such a configuration, since liquid is supplied from both sides of the energy generating element, high-speed driving becomes possible, and further, election ports and the vicinity thereof are more symmetrically arranged and droplets are ejected very straight, thus achieving enhancement of recording quality. One support member is provided in each space between adjacent supply ports, and the support member is provided so that a width thereof fits to an interval between the adjacent supply ports.

However, the liquid ejection head described in Japanese Patent Laid-Open No. 2013-233795 has a problem that, when thickness of the ejection port forming member is reduced, there is a case where the ejection port forming member is deformed, stress generated at an interface between the substrate and the support member tends to be easily concentrated, and peeling of the support member tends to easily occur.

SUMMARY OF THE INVENTION

The present disclosure provides a recording element substrate, a liquid ejection head, and a liquid ejection apparatus that achieve stable liquid ejection performance by suppressing concentration of stress on a support member due to swelling of an ejection port forming member while suppressing reduction in strength of the ejection port forming member against external force.

A recording element substrate according to an embodiment of the present disclosure includes: a substrate on which a plurality of energy generating elements that generate energy used for ejecting liquid are arranged side by side, an ejection port forming member in which ejection ports are formed at positions corresponding to the plurality of energy generating elements, a plurality of supply passages which are channels extending in a thickness direction of the substrate and through which liquid is supplied to the energy generating elements, and a support member that is formed between the substrate and the ejection port forming member and supports the ejection port forming member, in which supply ports that are apertures of the plurality of supply passages are linearly arranged side by side on the substrate, and a plurality of support members are provided side by side between adjacent supply ports on the substrate in a direction in which the supply ports are aligned.

Further features of the present disclosure will become apparent from the following description of exemplary embodiments with reference to the attached drawings.

DESCRIPTION OF THE EMBODIMENTS

Hereinafter, embodiments of the disclosure will be described with reference to attached drawings. Note that, the same reference signs are assigned to components having the same function in the present specification and the drawings, so that redundant description is omitted in some cases.

<First Embodiment>

Figure 1:
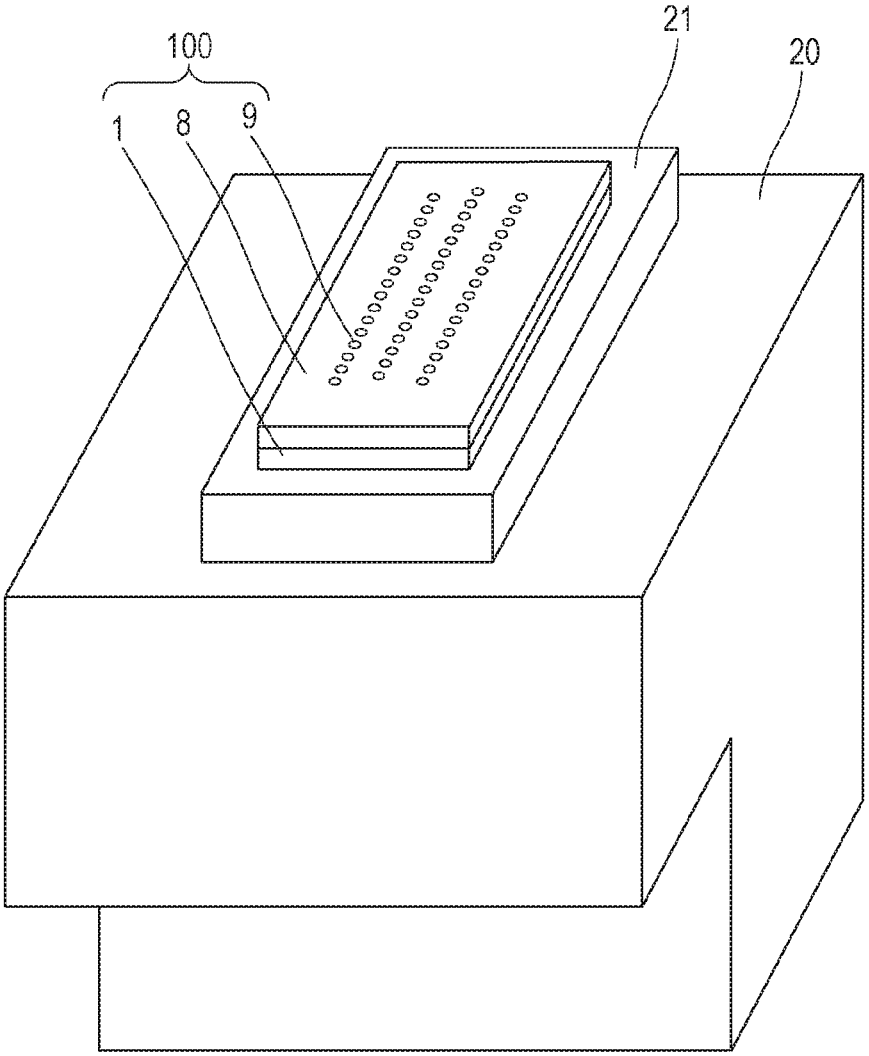
FIG. 1 is a perspective view for explaining a configuration of a liquid ejection head.

FIG. 1 is a perspective view for explaining a configuration of a liquid election head to which a recording element substrate according to a first embodiment of the disclosure is applied.

The liquid ejection head has a head body 20, a connection member 21, and a recording element substrate 100. The recording element substrate 100 has a substrate 1 and an ejection port forming member 8 provided on the substrate 1, and a plurality of ejection ports 9 are arranged side by side on the ejection port forming member 8. The recording element substrate 100 is provided on the head body 20 with the connection member 21 held therebetween. The liquid ejection head is mounted on a liquid ejection apparatus represented by an ink-jet recording apparatus, and ejects liquid such as ink from the ejection ports 9.

Figure 2:
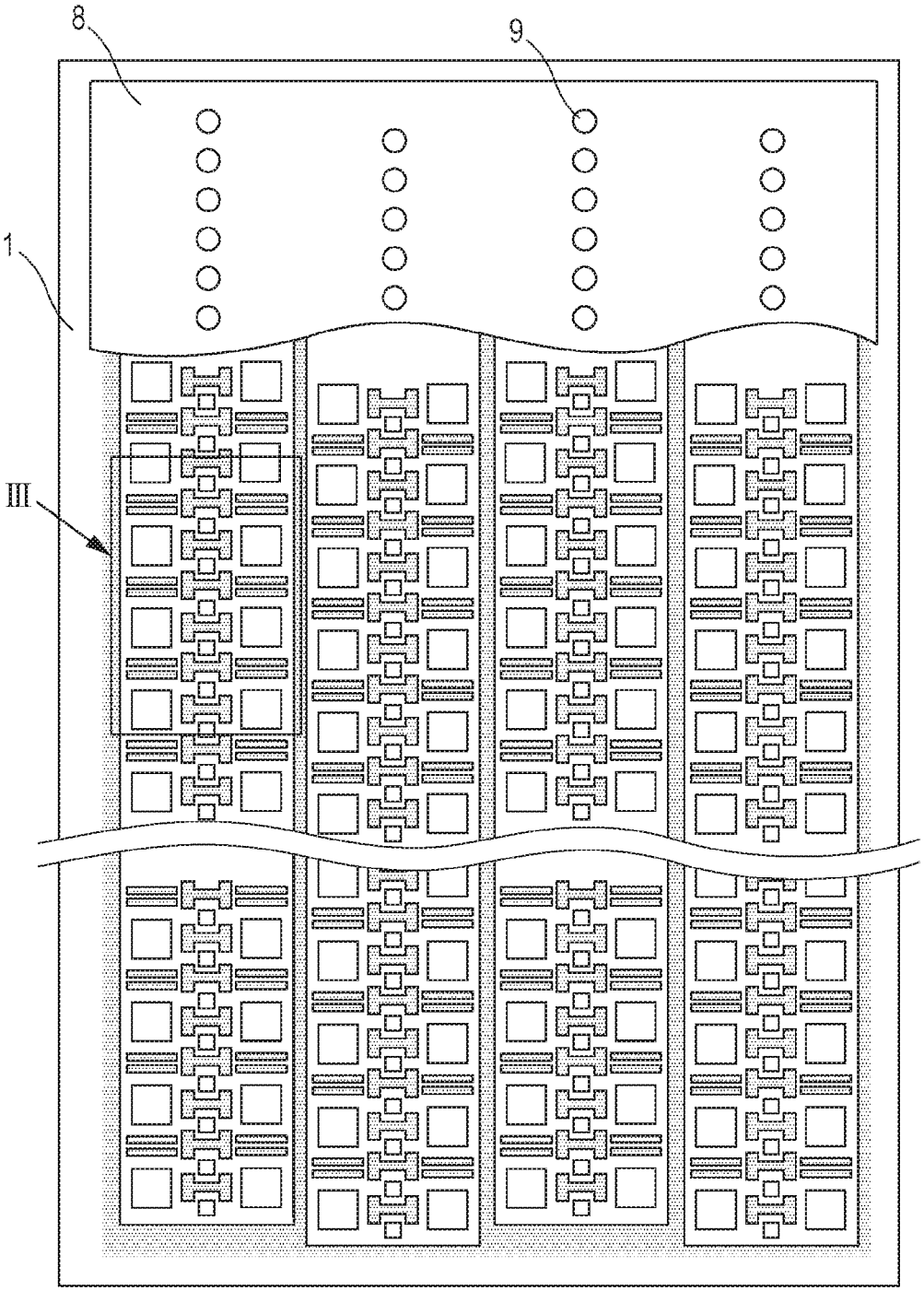
FIG. 2 illustrates a configuration of a recording element substrate according to a first embodiment of the disclosure.

FIG. 2 illustrates a configuration of the recording element substrate 100 according to the first embodiment of the disclosure.

The recording element substrate 100 has the substrate 1 and the ejection port forming member 8, and the plurality of ejection ports 9 are arranged side by side on the ejection port forming member 8. A lower side of FIG. 2 illustrates a state where the ejection port forming member 8 is removed from the recording element substrate 100, and illustrates a configuration on the substrate 1.

Figure 3A:
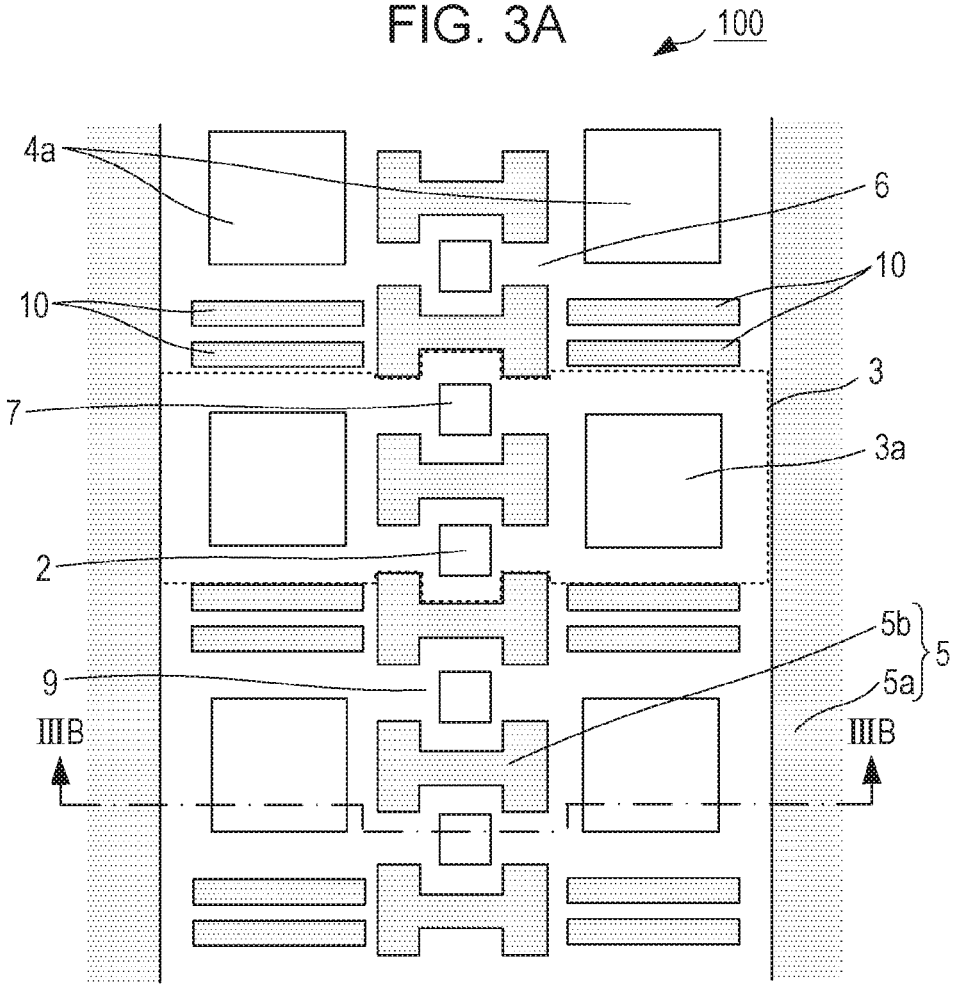
FIGS. 3A and 3B are views for explaining a detailed configuration of the recording element substrate of FIG. 2.
Figure 3B:
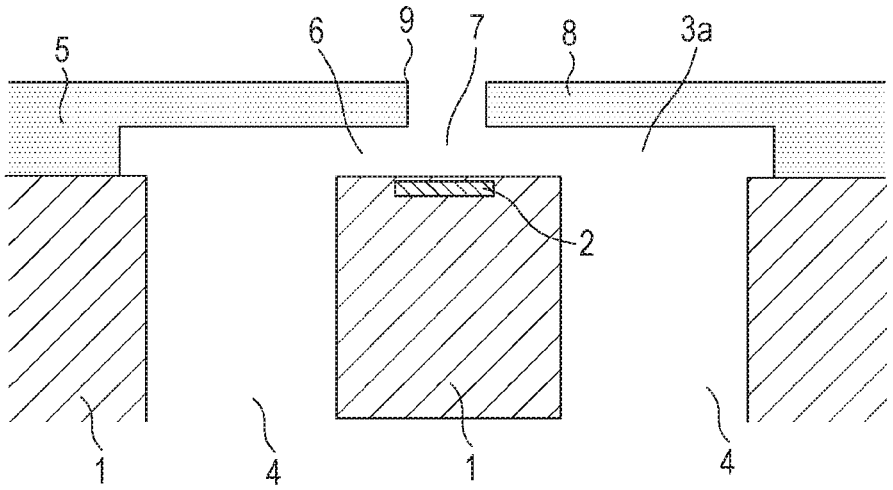

FIGS. 3A and 3B are views for explaining a more detailed configuration of the recording element substrate 100 of FIG. 2. FIG. 3A is an enlarged view of a part III of FIG. 2. FIG. 3B is a sectional view taken along a line IIIB-IIIB of FIG. 3A. Note that, FIG. 3A illustrates the configuration on the substrate 1 with the ejection port forming member 8 omitted, and FIG. 3B illustrates a sectional configuration including the ejection port forming member 8.

As illustrated in FIGS. 3A and 3B, an energy generating element array in which a plurality of energy generating elements 2 are linearly arranged side by side is formed on the substrate 1. On both sides of the energy generating elements 2, supply ports 4*a* of a plurality of supply passages 4 are arranged side by side as apertures on a side in which the energy generating elements 2 are provided. The supply passages 4 are channels extending in a thickness direction of the substrate 1 and are used to supply liquid to the energy generating elements 2. In the plurality of supply passages 4, the supply ports 4*a* are provided to be linearly aligned in substantially parallel to a direction in which the energy generating elements 2 are aligned.

Channel forming members 5 and support members 10 are provided between the substrate 1 and the ejection port forming member 8. A space between the substrate 1 and the ejection port forming member 8 is divided into a plurality of liquid chambers 3 by the channel forming members 5 and the support members 10. Each of the channel forming members 5 includes a wall member 5*a* that forms a continuous wall extending in the direction in which the energy generating elements 2 are aligned and a partition member 5*b* that forms a partition by which adjacent energy generating elements 2 are separated. Each of the liquid chambers 3 is a space that includes at least one energy generating element 2 and at least two supply ports 4*a* inside thereof and communicates with at least one ejection port 9. In an example of FIGS. 3A and 3B, the liquid chamber 3 is a space that includes two energy generating elements 2 and two supply ports 4*a* inside thereof and communicates with two ejection ports 9.

Each of the support members 10 is a plate member and provided in contact with the substrate 1. The support member 10 is provided between adjacent supply ports 4*a* on the substrate 1 and the plurality of support members 10 are arranged in a direction in which the supply ports 4*a* are aligned. In the present example, two support members 10 are provided between adjacent supply ports 4*a* on the surface of the substrate 1. Each of the support members 10 is arranged so that a thickness direction thereof is directed to the direction in which the supply ports 4*a* are aligned. The support member 10 is arranged so that a direction orthogonal to the direction in which the supply ports 4*a* are aligned on the surface of the substrate 1 serves as an in-plane direction of the support member 10 and the support member 10 is vertical to the substrate 1. In the example of FIGS. 3A and 3B, each of the support members 10 is provided separately from the wall member 5*a* and the partition member 5*b* and there is a gap between the respective members.

The plurality of supply ports 4*a* provided on the substrate 1 in a first direction in which the energy generating elements 2 are arrayed are referred to as a first supply port 4*a*, a second supply port 4*a*, and a third supply port 4*a* in arrangement order. A plurality of support members 10 aligned along the first direction are provided side by side between the first and second supply ports 4*a*. Other support members 10 different from the support members 10 provided between the first and second supply ports 4*a* are aligned along the first direction between the second and third supply ports 4*a*. Each of the support members 10 is a plate member extending in a second direction crossing the first direction.

The liquid chamber 3 includes: a common liquid chamber 3*a* that is a space separated by the wall member 5*a*, the partition member 5*b*, and the support members 10 and that includes the supply ports 4*a* of the supply passages 4; and a pressure chamber 7 that is a space separated by partition members 5*b* and includes the energy generating element 2 inside thereof. The liquid chamber 3 further includes a channel 6 by which the common liquid chamber 3*a* and the pressure chamber 7 are connected. Note that, a part in which the pressure chamber 7 and the channel 6 are connected has a shape having a narrow width in FIGS. 3A and 3B, but without limitation thereto, for example, the partition member 5*b* may have a straight shape like the support member 10.

Though not illustrated in FIG. 3A or 3B, in order to prevent impurities from entering the pressure chamber 7, a filter may be provided in a path through which liquid flows from the supply port 4*a* to the pressure chamber 7, for example, the channel 6.

An arrangement interval of the ejection ports 9 is 600 dpi and an arrangement interval of the supply ports 4*a* along the ejection ports 9 is 300 dpi. The supply ports 4*a* are provided on both sides with the energy generating elements 2, each of which is provided at a position corresponding to the ejection port 9, held therebetween, and liquid is supplied to the energy generating element 2 from the both sides. With such a configuration, liquid flows are more symmetrical around the ejection port 9, so that droplets are ejected very straight. Thus, droplets are easily applied to a desired position and this leads to enhancement of print image quality.

Each of the supply ports 4*a* has a square shape each side of which has 40 μm in the present embodiment, and each of the support members 10 has a length of 7 μm in the direction in which the supply ports 4*a* are aligned and a distance from the adjacent support member 10 of 5 μm. Above the supply port 4*a*, a space is provided between the ejection port forming member 8 and the substrate 1. Thus, it is desired that the support member 10 is provided around the supply port 4*a* to support the ejection port forming member 8. When the liquid election head is driven for a long time, the ejection port forming member 8 may be deformed due to swelling. In this case, shear force is generated at an interface between each of the support members 10 and the substrate 1 and the support member 10 is easily peeled off from the substrate 1 in some cases.

Figure 9A:
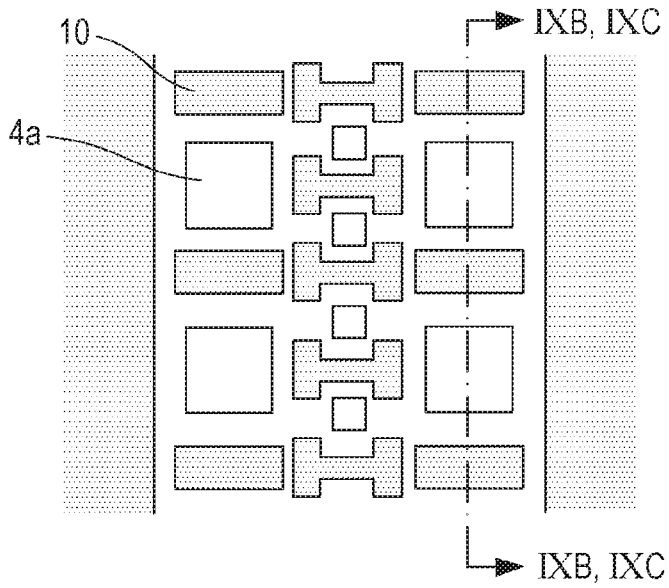
FIGS. 9A to 9C illustrate a comparative example of the disclosure.
Figure 9B:
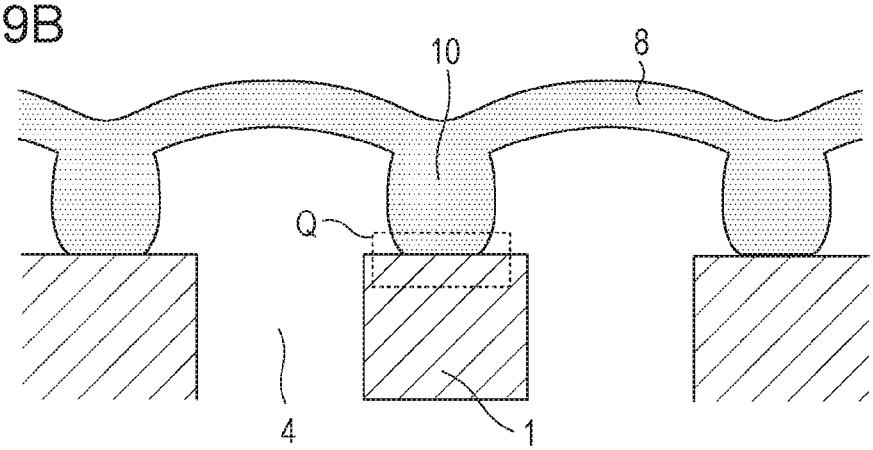
Figure 9C:
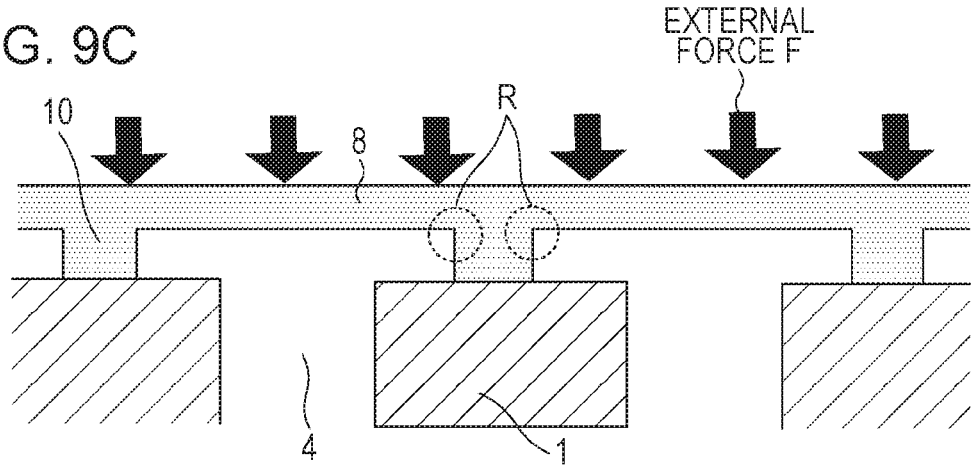

Next, an effect of the present embodiment will be described with reference to a comparative example of FIGS. 9A to 9C. FIG. 9A illustrates a configuration of a recording element substrate 900 according to the comparative example of the disclosure. FIG. 9B is a sectional view taken along a line IXB-IXB of FIG. 9A and highlights deformation due to swelling. FIG. 9C is a sectional view taken along a line IXC-IXC of FIG. 9A and illustrates a portion where shear stress is generated by external force. The recording element substrate 900 according to the comparative example is different from the recording element substrate 100 according to the first embodiment of the disclosure in that only one support member 10 is provided between supply ports 4*a* which are adjacent in the direction in which supply ports 4*a* are aligned. In this case, when the ejection port forming member 8 is deformed, shear stress is generated in a part between the support member 10 and the substrate 1, which is indicated as a part Q of FIG. 9B. When external force F is applied toward the substrate 1 from an upper part of the ejection port forming member 8 as illustrated in FIG. 9C, shear stress is generated in a part between the ejection port forming member 8 and the support member 10, which is indicated as each part R. As thickness of the ejection port forming member 8 is reduced, influence by the deformation and the external force F becomes great. In particular, when the thickness of the ejection port forming member 8 is about 11 μm or less, the influence becomes great.

Figure 4A:
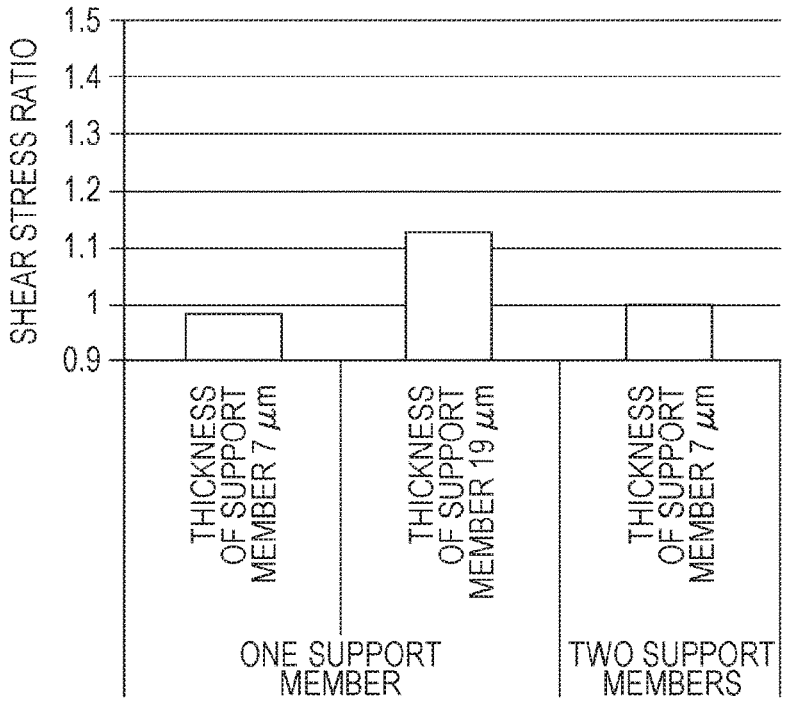
FIGS. 4A and 4B illustrate a relation between the number of support members and shear stress.
Figure 4B:
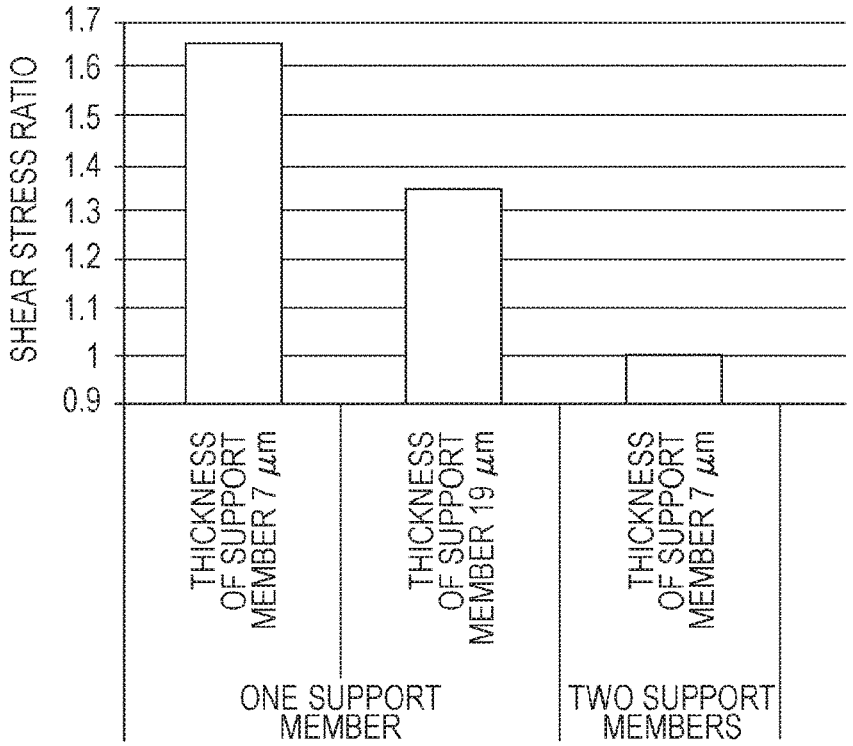

FIGS. 4A and 4B illustrate a relation between shear stress and a configuration of the support member 10. FIG. 4A illustrates, for each thickness of the support member 10 and the number of the support members 10, the shear stress in the part between the support member 10 and the substrate 1, which is indicated as the part Q of FIG. 9B. FIG. 4B illustrates, for each thickness of the support member 10 and the number of the support members 10, the shear stress in the part between the support member 10 and the election port forming member 8, which is indicated as the part R of FIG. 9C. Here, the thickness of the support member 10 indicates a length of the support member 10 in the direction in which the supply ports 4*a* are aligned. Note that, in FIGS. 4A and 4B, each vertical axis is indicated by a value (hereinafter, referred to as a shear stress ratio) obtained by standardizing the shear stress so that a value is 1 when the number of the support members 10 is two and the thickness of the support member 10 is 7 μm.

FIG. 4A indicates that, when the thickness of the support member 10 is changed from 19 μm to 7 μm in a configuration in which each one support member 10 is arranged between adjacent supply ports 4*a*, the shear stress between the support member 10 and the substrate 1 decreases. Also when two support members 10 each having the thickness of 7 μm are arranged between adjacent supply ports 4*a* as in the first embodiment of the disclosure, the shear stress is suppressed to the almost same degree as the case where one support member 10 having the thickness of 7 μm is arranged. FIG. 4B indicates that, when the thickness of the support member 10 is changed from 19 μm to 7 μm in a configuration in which each one support member 10 is arranged between adjacent supply ports 4*a*, the shear stress between the support member 10 and the election port forming member 8 increases. When the thickness of the support member 10 decreases, an interval between adjacent support members 10 with the supply port 4*a* held therebetween becomes wide, so that the shear stress between each of the support members 10 and the ejection port forming member 8 increases. When two support members 10 each having the thickness of 7 μm are arranged between adjacent supply ports 4*a* as in the first embodiment of the disclosure, the shear stress between each of the support members 10 and the ejection port forming member 8 decreases compared to the case where one support member 10 having the thickness of 19 μm is arranged. It is considered that this is because the interval between adjacent support members 10 becomes narrow by increasing the number of support members 10, so that the shear stress decreases, and further stress applied to the support members 10 is dispersed. Thus, even when the ejection port forming member 8 is deformed due to swelling or the external force F is applied, by arranging a plurality of support members 10 between adjacent supply ports 4*a* on the substrate 1, the stress between each of the support members 10 and the substrate 1 or the ejection port forming member 8 is able to be reduced. Accordingly, it is possible to suppress the influence of the deformation of the ejection port forming member 8 or the external force F and achieve stable liquid ejection performance of the liquid ejection head with the use of the recording element substrate 100.

<Second Embodiment>

Figure 5:
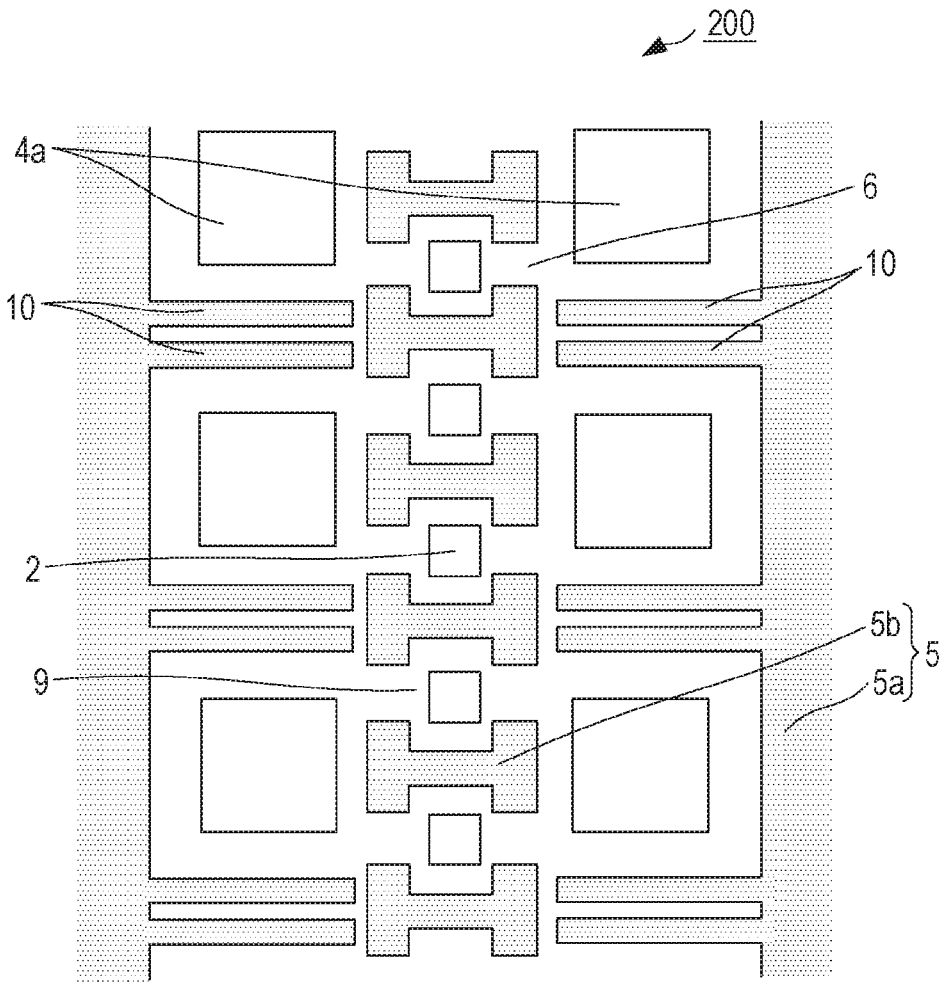
FIG. 5 illustrates a configuration of a recording element substrate according to a second embodiment of the disclosure.

FIG. 5 illustrates a configuration of a recording element substrate 200 according to a second embodiment of the disclosure. FIG. 5 illustrates a configuration on the substrate 1 with the election port forming member 8 omitted similarly to FIG. 3A. An entire configuration of the recording element substrate 200 is similar to that of the recording element substrate 100 illustrated in FIG. 2. A difference from the recording element substrate 100 according to the first embodiment will be mainly described below.

In the recording element substrate 200, the support member 10 is formed so as to be continuously integrated with the wall member 5*a* that forms the continuous wall extending in the direction in which the energy generating elements 2 are aligned. When the support member 10 is integrated with the wall member 5*a*, strength of the ejection port forming member 8 is further enhanced.

<Third Embodiment>

Figure 6:
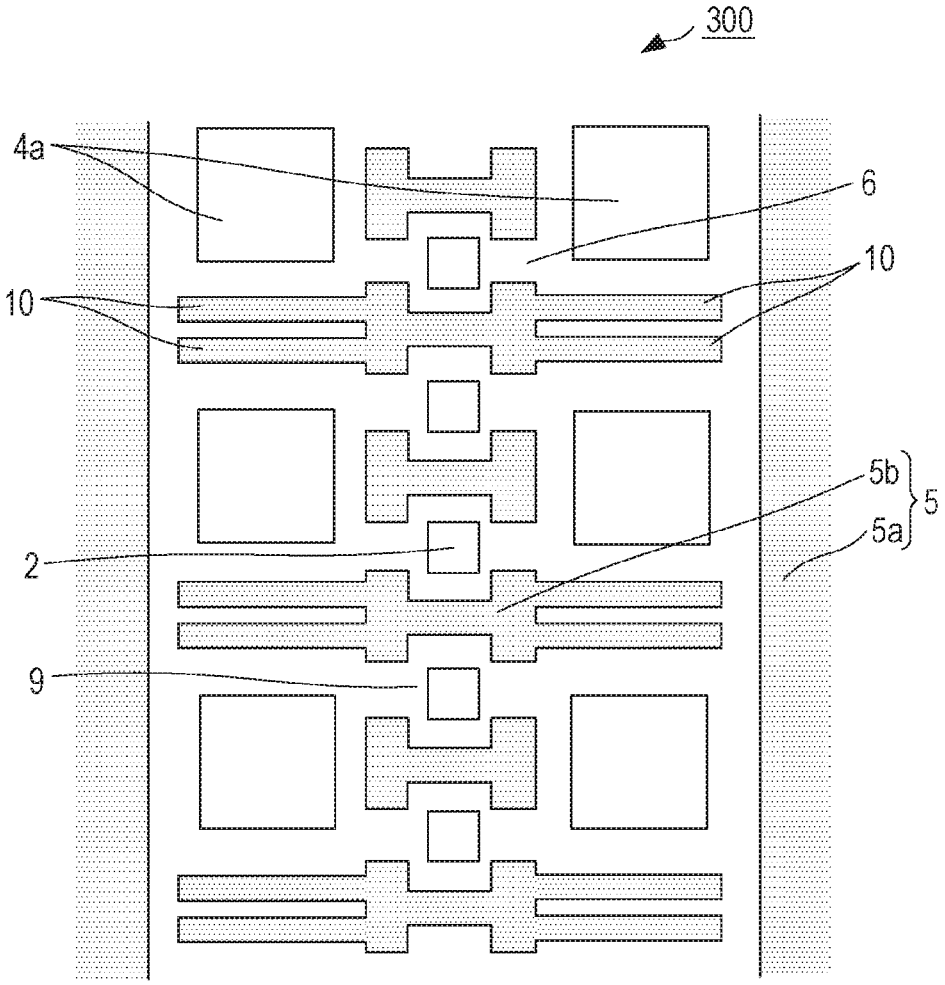
FIG. 6 illustrates a configuration of a recording element substrate according to a third embodiment of the disclosure.

FIG. 6 illustrates a configuration of a recording element substrate 300 according to a third embodiment of the disclosure. FIG. 6 also illustrates a configuration on the substrate 1 with the ejection port forming member 8 omitted similarly to FIG. 3A. An entire configuration of the recording element substrate 300 is similar to that of the recording element substrate 100 illustrated in FIG. 2. A difference from the recording element substrate 100 will be mainly described below.

In the recording element substrate 300, the support member 10 is formed so as to be continuously integrated with the partition member 5*b* that forms the partition by which adjacent energy generating elements 2 are separated. When the support member 10 is integrated with the partition member 5*b*, strength of the ejection port forming member 8 is enhanced.

<Fourth Embodiment>

Figure 7:
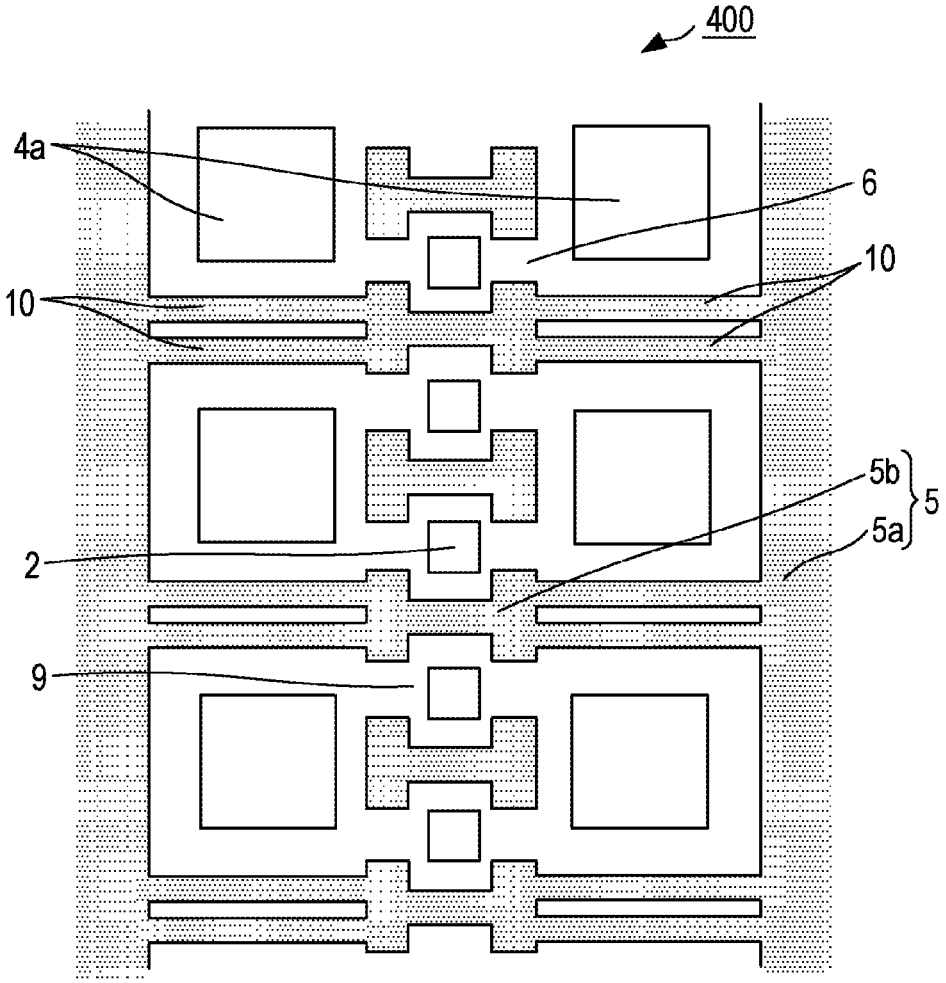
FIG. 7 illustrates a configuration of a recording element substrate according to a fourth embodiment of the disclosure.

FIG. 7 illustrates a configuration of a recording element substrate 400 according to a fourth embodiment of the disclosure. FIG. 7 also illustrates a configuration on the substrate 1 with the ejection port forming member 8 omitted similarly to FIG. 3A. An entire configuration of the recording element substrate 400 is similar to that of the recording element substrate 100 illustrated in FIG. 2. A difference from the recording element substrate 100 will be mainly described below.

In the recording element substrate 400, the support member 10 is formed so as to be continuously integrated with both the wall member 5*a* and the partition member 5*b*. When the support member 10 is integrated with both the wall member 5*a* and the partition member 5*b*, strength of the ejection port forming member 8 is further enhanced.

<Fifth Embodiment>

Figure 8:
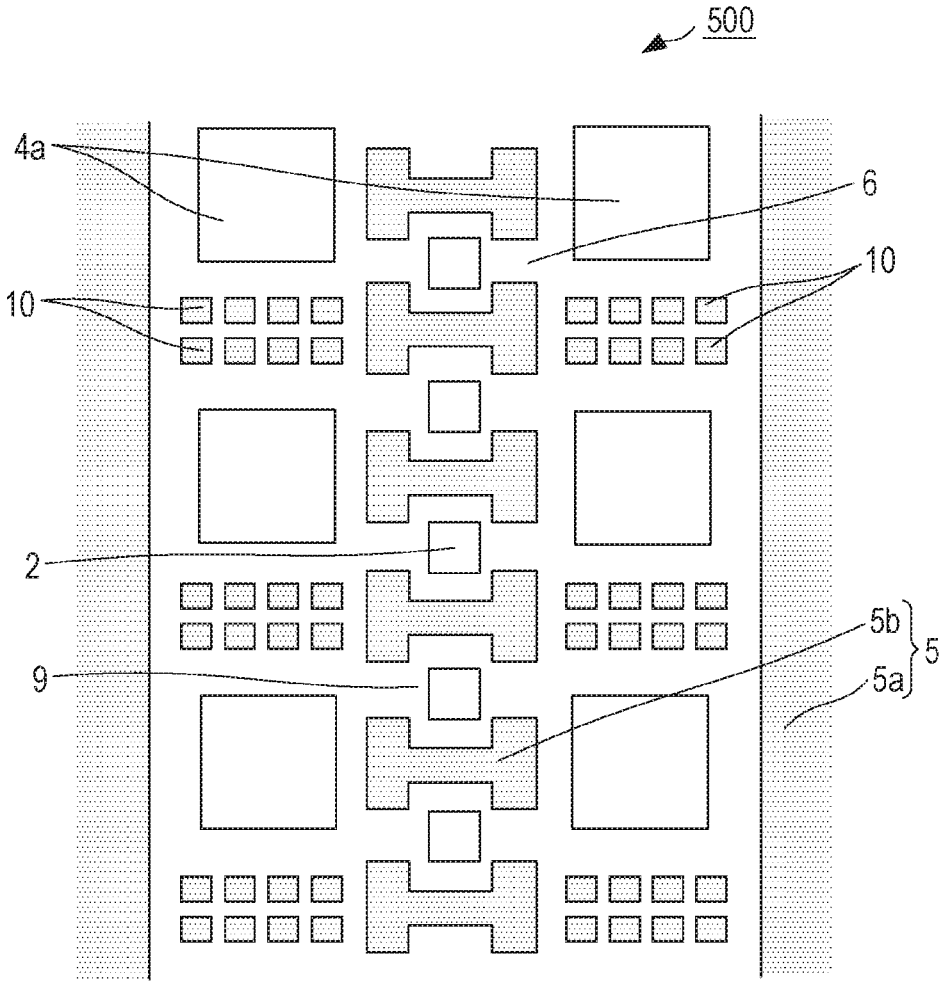
FIG. 8 illustrates a configuration of a recording element substrate according to a fifth embodiment of the disclosure.

FIG. 8 illustrates a configuration of a recording element substrate 500 according to a fifth embodiment of the disclosure. FIG. 8 also illustrates a configuration on the substrate 1 with the ejection port forming member 8 omitted similarly to FIG. 3A. An entire configuration of the recording element substrate 500 is similar to that of the recording element substrate 100 illustrated in FIG. 2. A difference from the recording element substrate 100 will be mainly described below.

In the first to fourth embodiments, the support member 10 is a plate member, and between adjacent supply ports 4*a*, a plurality of support members 10 are arranged in the direction in which the supply ports 4*a* are aligned and one support member 10 is arranged in the direction crossing (in FIG. 8, orthogonal to) the direction in which the supply ports 4*a* are aligned. In the fifth embodiment, a plurality of support members 10 are arranged also in the direction crossing the direction in which the supply ports 4*a* are aligned. Specifically, the recording element substrate 500 has eight columnar support members 10 in total between adjacent supply ports 4*a*. The eight columnar support members 10 are arranged such that two support members 10 are in the direction in which the supply ports 4*a* are aligned and four support members 10 are in the direction orthogonal to the direction in which the supply ports 4*a* are aligned.

In the recording element substrate 500, an arrangement interval of the energy generating elements 2 is 600 dpi and the ejection ports 9 are arranged at positions corresponding to the energy generating elements 2, and therefore an arrangement interval of the ejection ports 9 is also 600 dpi. On each side of the energy generating elements 2, one supply port 4*a* is arranged for two energy generating elements 2, and an arrangement interval of the supply ports 4*a* is 300 dpi. In the direction in which the supply ports 4*a* are aligned, a length of the support member 10 is 7 μm and an interval between adjacent support members 10 is 5 μm. Also in the direction orthogonal to the direction in which the supply ports 4*a* are aligned, an interval between adjacent support members 10 is 5 μm.

As described above, when the plurality of columnar support members 10 are arranged side by side between adjacent supply ports 4*a* in both the direction in which the supply ports 4*a* are aligned and the direction crossing the direction in which the supply ports 4*a* are aligned, liquid flows between the adjacent supply ports 4*a*. Such a configuration makes it possible to prevent bubbles from retaining in the common liquid chamber 3*a*, thus making it possible to achieve more stable liquid ejection performance. Moreover, since the interval between the adjacent support members 10 becomes narrow, it is possible to enhance strength of the ejection port forming member 8 against the external force. Note that, though eight support members 10 are provided in each space between the supply ports 4*a* in the present exemplary embodiment, the number is not limited thereto. It may be configured so that at least two support members 10 are arranged side by side between the supply ports 4*a* and the different number of support members 10 may be arranged in each space between the supply ports 4*a*. A shape of each of the support members 10 is also not limited to the configuration of FIG. 8, and, for example, a configuration may be used in which support members having smaller thickness are arranged side by side.

Though the present disclosure has been described above with reference to the embodiments, the present disclosure is not limited to the aforementioned embodiments. Various modifications that can be understood by a person skilled in the art may be made to the configuration of the invention within a range of technical ideas of the present disclosure.

For example, though the number of the support members 10 provided between adjacent supply ports 4*a* in the direction in which the supply ports 4*a* are aligned is two in the aforementioned embodiments, the disclosure is not limited to such an example. For example, three or more support members 10 may be provided between the adjacent supply ports 4*a*. In addition, though the support member 10 has a rectangular shape as a sectional shape parallel to the surface of the substrate 1 in the aforementioned embodiments, the disclosure is not limited to such an example. For example, the sectional shape of the support member 10 may be a circular shape, an elliptical shape, or other polygonal shapes other than the rectangular shape.

In the recoding element substrate, one supply port 4*a* per two energy generating elements 2 is provided on each side of an element array in which the energy generating elements 2 are aligned in the aforementioned embodiments, but the disclosure is not limited to such an example. Arrangement of the respective components on the substrate 1 may be variously modified.

For example, though all supply passages 4 provided on the both sides of the energy generating elements 2 are channels through which liquid is supplied to the pressure chamber 7 and the liquid flows from the supply passage 4 to the pressure chamber 7 in the aforementioned embodiments, the disclosure is not limited to such an example. For example, one of the supply passages 4 on the both sides of the energy generating elements 2 may function as a collection passage by which liquid is collected from the pressure chamber 7. In this case, the liquid is collected from one of the supply passages 4 to the other supply passage 4 through the pressure chamber 7. Such a configuration makes it possible to achieve a configuration in which liquid in the pressure chamber 7 is circulated with the liquid outside the pressure chamber 7.

According to the disclosure, it is possible to realize stable liquid ejection performance by suppressing concentration of stress on a support member due to swelling of an ejection port forming member while suppressing reduction in strength of the ejection port forming member against external force.

While the present disclosure has been described with reference to exemplary embodiments, it is to be understood that the disclosure is not limited to the disclosed exemplary embodiments. The scope of the following claims is to be accorded the broadest interpretation so as to encompass all such modifications and equivalent structures and functions.

This application claims the benefit of Japanese Patent Application No. 2016-102182 filed May 23, 2016, which is hereby incorporated by reference herein in its entirety.

What is claimed is:

1. A recording element substrate, comprising:

a substrate on which a plurality of energy generating elements that generate energy to be used for ejecting liquid are arranged side by side;

an ejection port forming member in which ejection ports are formed at positions corresponding to the plurality of energy generating elements;

a plurality of supply passages which are channels extending in a thickness direction of the substrate and through which liquid is supplied to the plurality of energy generating elements, wherein a plurality of supply ports are apertures of the plurality of supply passages on a side in which the plurality of energy generating elements are provided, and are linearly arranged side by side on the substrate;

a plurality of support members provided side by side between two adjacent supply ports of the plurality of supply ports on the substrate in a direction in which the supply ports are aligned, wherein each of the support members is formed between the substrate and the ejection port forming member and supports the ejection port forming member;

a liquid chamber that includes therein at least one of the energy generating elements of the plurality of energy generating elements and at least two of the supply ports of the plurality of supply ports and communicates with at least one of the ejection ports; and a wall member that is formed between the substrate and the ejection port forming member and forms a wall of the liquid chamber, the wall extending in a direction in which the plurality of energy generating elements are aligned, wherein at least one of the support members is continuous with the wall member.

2. The recording element substrate according to claim 1, wherein at least one of the plurality of support members is in contact with the substrate.

3. The recording element substrate according to claim 1, wherein a plurality of support members supporting the ejection port forming member are provided between the adjacent supply ports of the plurality of supply ports, on the substrate, in a direction orthogonal to the direction in which the supply ports are aligned.

4. The recording element substrate according to claim 1, further comprising:

a partition member provided between two adjacent energy generating elements of the plurality of energy generating elements, wherein at least one of the support members is continuous with the partition member and the wall member.

5. The recording element substrate according to claim 1, further comprising:

a partition member provided between two adjacent energy generating elements of the plurality of energy generating elements, wherein at least one of the support members is provided separately from the partition member and the wall member.

6. The recording element substrate according to claim 1, further comprising:

a pressure chamber having therein the at least one of the energy generating elements of the plurality of energy generating elements, wherein liquid in the pressure chamber is circulated with liquid outside the pressure chamber.

7. A recording element substrate, comprising:

a substrate on which a plurality of energy generating elements that generate energy to be used for ejecting liquid are arranged side by side;

an ejection port forming member in which ejection ports are formed at positions corresponding to the plurality of energy generating elements;

a plurality of supply passages which are channels extending in a thickness direction of the substrate and through which liquid is supplied to the plurality of energy generating elements, wherein a plurality of supply ports are apertures of the plurality of supply passages on a side in which the plurality of energy generating elements are provided, and are linearly arranged side by side on the substrate;

a plurality of support members provided side by side between two adjacent supply ports of the plurality of supply ports, on the substrate, in a direction in which the supply ports are aligned, wherein each of the support members is formed between the substrate and the ejection port forming member and supports the ejection port forming member; and a partition member provided between two adjacent energy generating elements of the plurality of energy generating elements, wherein at least one of the support members of the plurality of support members is continuous with the partition member.

8. The recording element substrate according to claim 7, further comprising:

a pressure chamber having therein at least one of the energy generating elements of the plurality of energy generating elements, wherein liquid in the pressure chamber is circulated with liquid outside the pressure chamber.

* * * * *